US009127611B2

(12) United States Patent
Graf

(10) Patent No.: US 9,127,611 B2
(45) Date of Patent: Sep. 8, 2015

(54) METHOD FOR MONITORING AN ELECTROMOTIVELY DRIVEN FUEL PUMP AND FUEL FEED UNIT HAVING A FUEL PUMP

(75) Inventor: Rolf Graf, Glashütten (DE)

(73) Assignee: Continental Automotive GmbH, Hannover (DE)

( * ) Notice: Subject to any disclaimer, the term of this patent is extended or adjusted under 35 U.S.C. 154(b) by 102 days.

(21) Appl. No.: 13/428,993

(22) Filed: Mar. 23, 2012

(65) Prior Publication Data

US 2012/0245819 A1 Sep. 27, 2012

(30) Foreign Application Priority Data

Mar. 25, 2011 (DE) ..... 10 2011 015 154

(51) Int. Cl.
*F02D 41/22* (2006.01)
*F02D 41/30* (2006.01)
*F02D 41/20* (2006.01)

(52) U.S. Cl.
CPC ..... *F02D 41/221* (2013.01); *F02D 41/3082* (2013.01); *F02D 2041/2058* (2013.01); *F02D 2041/224* (2013.01); *F02D 2041/225* (2013.01); *F23N 2023/08* (2013.01); *F23N 2027/16* (2013.01); *F23N 2031/20* (2013.01)

(58) Field of Classification Search
CPC ..... B60R 13/0232; F23N 2023/08; F23N 2027/16; F23N 2031/20; F23N 2035/30
USPC ..... 701/29.1, 29.2, 32.9, 33.9; 417/9, 12, 417/18, 44.1, 44.11, 45, 63
See application file for complete search history.

(56) References Cited

U.S. PATENT DOCUMENTS

| | | | | |
|---|---|---|---|---|
| 5,350,114 | A * | 9/1994 | Nelson et al. | 237/2 A |
| 6,941,785 | B2 * | 9/2005 | Haynes et al. | 72/57 |
| 2009/0095061 | A1 * | 4/2009 | Fujino et al. | 73/114.41 |

FOREIGN PATENT DOCUMENTS

| | | | |
|---|---|---|---|
| DE | 601 15 812 | T2 | 8/2006 |
| DE | 10 2006 004 296 | A1 | 8/2007 |
| DE | 102006004296 | A1 * | 8/2007 |
| DE | 10 2008 041 569 | A1 | 3/2010 |
| DE | 102008041569 | A1 * | 3/2010 |
| EP | 1201905 | B1 * | 12/2005 |

OTHER PUBLICATIONS

Alexander Gray, Principles and Practice of Electrical Engineering, 2nd Edition, pp. 90-93.*

* cited by examiner

*Primary Examiner* — Fadey Jabr
*Assistant Examiner* — Thomas Ingram
(74) *Attorney, Agent, or Firm* — Cozen O'Connor

(57) ABSTRACT

During monitoring of an electromotively driven fuel pump of a fuel feed unit for a motor vehicle, a pump current is monitored as a function of a pump voltage or of a pump rotational speed. Through a comparison of the pump current with the pump voltage or the pump rotational speed, it is detected whether leakage or dry running of the fuel pump is present. The fuel feed unit does not require any pressure sensor for this purpose, and is therefore of particularly simple construction.

13 Claims, 1 Drawing Sheet

METHOD FOR MONITORING AN ELECTROMOTIVELY DRIVEN FUEL PUMP AND FUEL FEED UNIT HAVING A FUEL PUMP

BACKGROUND OF THE INVENTION

1. Field of the Invention

The invention relates to a method for monitoring an electromotively driven fuel pump of a fuel feed unit for a motor vehicle, in which a pump control apparatus supplies the fuel pump with electrical current and to a fuel feed unit for a motor vehicle having an electromotively driven fuel pump and having a pump control apparatus for activating the fuel pump.

2. Description of the Related Art

In fuel feed units, there is a risk that the fuel pump does not receive any fuel and may therefore run dry, or that fuel escapes into the environment in the event of a leak. Because of a failure of lubrication dry running of the fuel pump leads to rapid wear and failure of the fuel pump. Leakage outside a fuel tank receiving the fuel pump pollutes and endangers the environment.

The fuel feed unit could be monitored by a pressure sensor and the risks mentioned could be detected, since the pressure generated by the fuel pump falls drastically in the event of dry running or leakage. However, such a pressure sensor entails a high outlay in structural terms. Moreover, in the most unfavorable case, the pressure sensor itself is a fault source.

SUMMARY OF THE INVENTION

The invention provides a method of the type initially mentioned, such that it is possible to monitor the fuel feed unit without a pressure sensor. Furthermore, a fuel feed unit is provided that can be monitored without a pressure sensor.

The first-mentioned problem is solved, according to one embodiment of the invention, in that the delivery of the pump current to the fuel pump is monitored as a function of the pump voltage on the fuel pump or of the pump rotational speed of the fuel pump, and a fault message is output when a limit value is undershot.

By virtue of this configuration, a pressure drop is detected indirectly via parameters of the fuel pump. If the pump current of the fuel pump falls while the pump voltage is constant or the pump rotational speed is constant, this is an indication that a leak is present or that the fuel pump is running dry. This monitoring of the pump current and linking to further system parameters of the fuel pump are possible with existing devices by software. There is therefore no need for direct measurement of the pressure of the fuel pump.

According to one embodiment of the invention, an erroneous output of fault messages can be largely avoided if the fault message is output only after the undershooting of the limit value after an intended time span. Transient processes are filtered out as a result of this configuration.

Different causes of faults can be detected from a different behavior of the fuel pump. According to one embodiment development of the invention, different fault messages can be output for different causes if a plurality of limit values are prepared and a dedicated fault message is output for each limit value. By virtue of this configuration a leakage of the fuel feed unit can be distinguished from dry running of the fuel pump because the pump current delivered to the fuel pump is lower in the event of dry running than in the event of leakage. In the event of leakage, the pump current is lower than when the fuel pump is operating normally.

According to one embodiment of the invention, damage to the fuel pump by dry running or a high outflow of fuel in the event of leakage can be avoided in a simple way if the fuel pump is switched off when a limit value of the pump current is undershot. By virtue of this configuration, the method according to the invention is utilized in order to avoid damage to the fuel feed unit or due to outflowing fuel.

According to one embodiment of the invention, a fault of the fuel feed unit can be monitored during overall operation if a characteristic diagram of the pump current delivered to the fuel pump is monitored by the pump voltage or the pump rotational speed. By virtue of this configuration, the limit value is a curve in the characteristic diagram and is consequently dependent on the pump voltage and the pump rotational speed.

The second-mentioned problem, to be precise, the provision of a fuel feed unit that can be monitored without a pressure sensor, is solved, according to one embodiment the invention, by a device for monitoring the parameters of the pump current delivered to the fuel pump, in conjunction with the pump voltage and/or pump rotational speed of the fuel pump, and by a computing unit for comparing the signals from the monitoring device with stored limit values of the fuel pump.

By virtue of this configuration, various parameters of the fuel pump are monitored and, after a comparison of the parameters with a limit value, the presence of a fault is deduced. The mounting of an additional pressure sensor can be avoided by the invention.

The fuel feed unit according to one embodiment of the invention can be monitored for faults during operation if the device for monitoring parameters performs characteristic diagram monitoring.

The fuel feed unit according to one embodiment of the invention is especially simple in structural terms if the pump control apparatus has the device for characteristic diagram monitoring and/or the computing unit. By virtue of this configuration, the number of components to be mounted is kept especially low.

The fuel feed unit according to one embodiment of the invention can be manufactured especially cost-effectively if the pump control apparatus has a microprocessor for characteristic diagram monitoring and for comparing the signals from the characteristic diagram monitoring with the stored limit values. Since pump control apparatuses often in any case use a microprocessor for activating the fuel pump, this configuration does not lead to an increase in the outlay for the fuel feed unit in structural terms.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention permits numerous embodiments. To make its basic principle even clearer, one of these is illustrated in the drawing and is described below. In the drawings.

DETAILED DESCRIPTION OF THE PRESENTLY PREFERRED EMBODIMENTS

Figure 1:
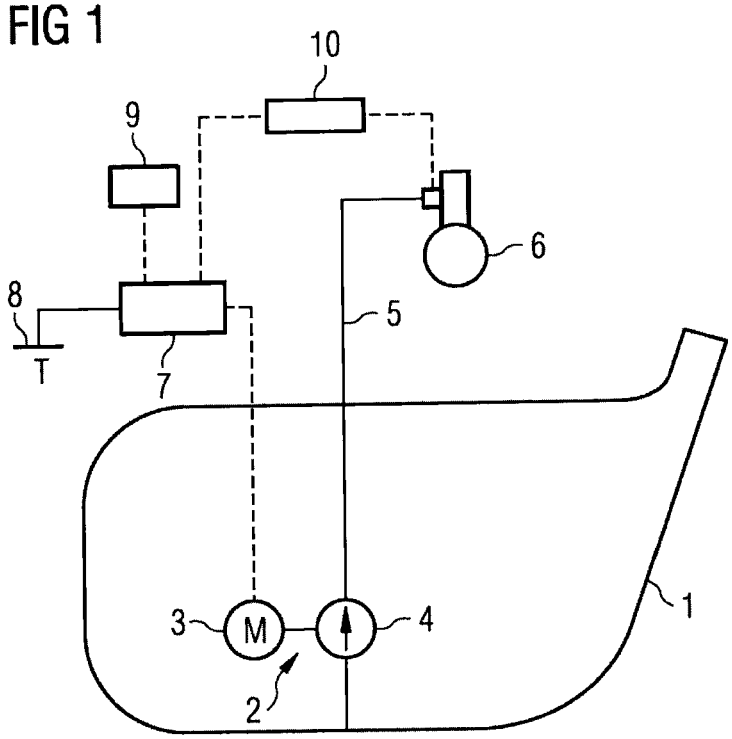
FIG. 1 is diagram of a fuel feed unit of a motor vehicle.

FIG. 1 shows a fuel feed unit of a motor vehicle with a fuel pump 2 arranged in a fuel tank 1. The fuel pump 2 has a pump stage 4 driven by an electric motor 3 and feeds fuel out of the fuel tank 1 via a forward flow line 5 to an internal combustion engine 6. The electric motor 3 is supplied via a pump control apparatus 7 with electrical current from a power supply 8 of a motor vehicle. The pump control apparatus 7 is connected to an indicator 9 on which fault messages relating to the fuel pump 2 can be displayed. Furthermore, the pump control apparatus 7 has a connection to an engine control apparatus 10 of the internal combustion engine 6.

Figure 2:
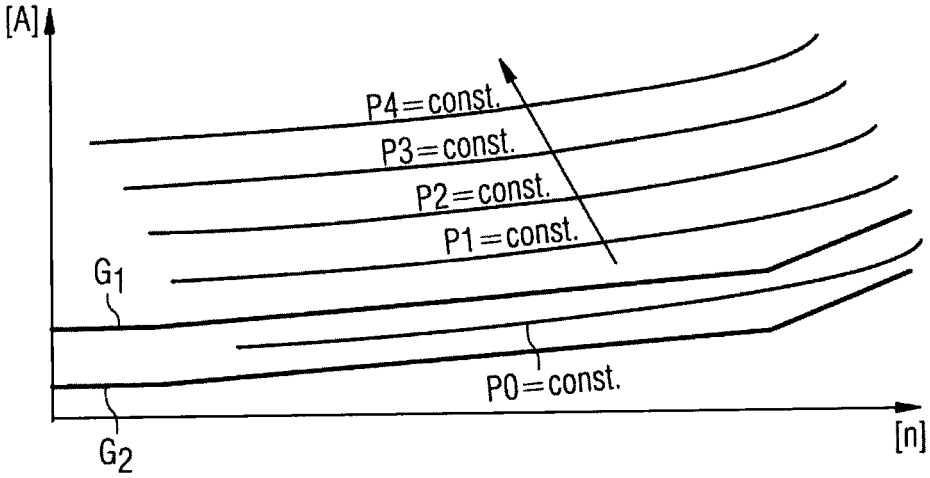
FIG. 2 is a graph for activating a fuel pump of the fuel feed unit from FIG. 1.

FIG. 2 a graph a characteristic diagram of the pump pressure [P] of the fuel pump 2 from FIG. 1 as a function of the pump current [A] delivered electronically to the fuel pump 2, against the pump rotational speed [n]. Moreover, the courses of two limit values G1 and G2 of the minimum pump pressure are illustrated in FIG. 2. The limit value G1 corresponds to the pump pressure in the event of leakage of the fuel feed unit from FIG. 1, for example a leak in the forward flow line 5. The limit value G2 describes dry running of the fuel pump 2 in which the pump rotational speed rises sharply even in the case of low pump currents, without pump pressure being generated. The graph illustrated is characteristic of a brushless electric motor 3. In one embodiment of the invention the pump voltage may be illustrated, instead of the pump rotational speed, in the case of a brush-fitted electric motor 3.

The method for operating the fuel pump 2 provides for deriving the pump pressure generated by the fuel pump 2 from the pump current illustrated in FIG. 2 and the pump rotational speed or the pump voltage on the basis of a stored characteristic diagram. The values required for this purpose are available to the pump control apparatus 7. If the derived pump pressure undershoots the limit value G1 or G2, a fault message is displayed on the indicator 9 and/or the internal combustion engine 6 is switched off via the engine control apparatus 10.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for monitoring an electromotively driven fuel pump of a fuel feed unit for a motor vehicle, in which a pump control apparatus supplies the fuel pump with electrical current, comprising:

monitoring, by a processor, delivery of the pump current to the fuel pump as a function of a pump rotational speed of the fuel pump; and outputting, by the processor, a fault message, based on the monitored pump current, when a limit value is undershot, wherein the limit value comprises a first value representing a leakage of the fuel feed unit and a second value representing a dry running of the fuel pump and wherein the fuel feed unit is monitored without a pressure sensor.

2. The method as claimed in claim 1, wherein the fault message is output only after the undershooting of the limit value after an intended time span.

3. The method as claimed in claim 2, wherein a plurality of limit values are prepared and a dedicated fault message is output for each limit value.

4. The method as claimed in claim 3, wherein the fuel pump is switched off when one of the plural limit values of the pump current is undershot.

5. The method as claimed in claim 1, wherein a plurality of limit values are prepared and a dedicated fault message is output for each limit value.

6. The method as claimed in claim 5, wherein the fuel pump is switched off when one of the plural limit value of the pump current is undershot.

7. The method as claimed in one of the preceding claims, further comprising:

monitoring the at least one of the pump voltage and the pump rotational speed with respect to a characteristic diagram of the pump current.

8. A fuel feed unit for a motor vehicle comprising:

an electromotively driven fuel pump and having a pump control apparatus for activating the fuel pump;

a device for monitoring one or more parameters of a pump current delivered to the fuel pump, in conjunction with a pump rotational speed of the fuel pump; and a computing unit configured to compare signals from the monitoring device with stored limit values of the fuel pump, wherein a first stored value represents a leakage of the fuel feed unit and a second stored value represents dry running of the fuel pump and wherein the fuel feed unit is monitored without a pressure sensor.

9. The fuel feed unit as claimed in claim 8, wherein the device for monitoring the parameters is configured for characteristic diagram monitoring.

10. The fuel feed unit as claimed in claim 9, wherein the pump control apparatus comprises at least one of a device for characteristic diagram monitoring and the computing unit.

11. The fuel feed unit as claimed in claim 10, wherein the pump control apparatus has a microprocessor for characteristic diagram monitoring and for comparing the signals from the characteristic diagram monitoring with the stored limit values.

12. The fuel feed unit as claimed in claim 8, wherein the pump control apparatus comprises at least one of a device for characteristic diagram monitoring and the computing unit.

13. The fuel feed unit as claimed in claim 8, wherein the pump control apparatus has a microprocessor for characteristic diagram monitoring and for comparing the signals from the characteristic diagram monitoring with the stored limit values.

* * * * *